US010808983B2

(12) United States Patent
Oh et al.

(10) Patent No.: US 10,808,983 B2
(45) Date of Patent: Oct. 20, 2020

(54) REFRIGERATOR

(71) Applicant: LG ELECTRONICS INC., Seoul (KR)

(72) Inventors: Minkyu Oh, Seoul (KR); Heayoun Sul, Seoul (KR); Hyoungkeun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 208 days.

(21) Appl. No.: 15/688,389

(22) Filed: Aug. 28, 2017

(65) Prior Publication Data

US 2018/0066883 A1 Mar. 8, 2018

(30) Foreign Application Priority Data

Sep. 2, 2016 (KR) ..... 10-2016-0113427

(51) Int. Cl.
*F25D 11/02* (2006.01)
*F25B 21/02* (2006.01)
(Continued)

(52) U.S. Cl.
CPC ..... *F25D 11/022* (2013.01); *F25B 21/02* (2013.01); *F25B 25/00* (2013.01); *F25B 39/02* (2013.01); *F25D 11/04* (2013.01); *F25D 17/06* (2013.01)

(58) Field of Classification Search
CPC ..... F25D 17/06; F25D 11/022; F25D 11/04; F25B 32/02; F25B 32/00; F25B 39/02;
(Continued)

(56) References Cited

U.S. PATENT DOCUMENTS 5,269,146 A 12/1993 Kerner
2012/0073309 A1* 3/2012 Hung ..... F25B 21/02 62/3.3
2012/0304667 A1* 12/2012 Shin ..... F25B 21/02 62/3.6

FOREIGN PATENT DOCUMENTS

EP 2530408 12/2012
JP 02064396 A * 3/1990 ..... F28D 1/0477
(Continued)

OTHER PUBLICATIONS

Partial English Machine Translation: KR 20130049496: Accessed Aug. 2019.*
(Continued)

*Primary Examiner* — Tavia Sullens
(74) *Attorney, Agent, or Firm* — KED & Associates LLP

(57) ABSTRACT

A refrigerator may have an ultra-low temperature cooling module for cooling an ultra-low temperature compartment that includes a thermoelectric element having a heating surface and a heat absorption surface disposed to oppose the heating surface and a heat conduction unit evaporation part whose one side is in contact with the heating surface of the thermoelectric element and the other side is connected to a refrigerant pipe of an evaporator to transmit heat emitted from the heating surface of the thermoelectric element to the refrigerant. An amount of heat exchange between a central portion of the heating surface having a relatively high temperature and a refrigerant of the heat conduction unit evaporation part may be greater than an amount of heat exchange between a peripheral portion of the heating surface surrounding the central portion and the refrigerant.

12 Claims, 16 Drawing Sheets

(51) Int. Cl.

| | |
|---|---|
| ***F25B 39/02*** | (2006.01) |
| ***F25B 25/00*** | (2006.01) |
| ***F25D 11/04*** | (2006.01) |
| ***F25D 17/06*** | (2006.01) |

(58) Field of Classification Search
CPC ..... F25B 39/022; F25B 2339/022; F25B 2331/02
See application file for complete search history.

(56) References Cited

FOREIGN PATENT DOCUMENTS

| | | |
|---|---|---|
| JP | 2004-278890 | 10/2004 |
| JP | 2012-251765 | 12/2012 |
| KR | 10-1999-0041822 | 6/1999 |
| KR | 2012 0133287 | 12/2012 |
| KR | 2013 0049496 | 5/2013 |
| KR | 10-2016-0097648 | 8/2016 |

OTHER PUBLICATIONS

Extended European Search Report issued in Application EP 17 18 8851 dated Dec. 14, 2017.
Extended European Search Report dated Mar. 3, 2020 issued in Application 19212554.0.

* cited by examiner

REFRIGERATOR

CROSS-REFERENCE TO RELATED APPLICATION

This application claims the benefit of earlier filing date and right of priority under 35 U.S.C. § 119(a) from Korean Application No. 10-2016-0113427, filed Sep. 2, 2016, the contents of which is incorporated herein by reference.

BACKGROUND

1. Field

The present disclosure relates to a refrigerator having an ultra-low temperature compartment maintained at a temperature lower than that of a freezing compartment.

2. Background

A refrigerator is a home appliance including a freezing compartment (or a freezing chamber) and a chilling compartment (or a refrigerating chamber) within a main body to store food items at preset temperatures within the freezing compartment and the chilling compartment to keep food items fresh.

When meat or fish is frozen within short time in a freezing point temperature zone in which ice is formed within cells, damage to cells may be minimized and qualities of meat or fish may be maintained even after defrosting to allow for a tasty dish.

For this reason there is, consumer demand for an extra storage space in which food items can be quickly frozen at a temperature lower than that of the freezing compartment, in addition to the chilling compartment or the freezing compartment.

A refrigerator may have a quick cooling module for quickly cooling a separate storage space (hereinafter referred to as an "ultra-low temperature compartment").

BRIEF DESCRIPTION OF THE DRAWINGS

Arrangements and embodiments may be described in detail with reference to the following drawings in which like reference numerals refer to like elements wherein.

DETAILED DESCRIPTION

Description may now be given in detail of the exemplary arrangements and embodiments, with reference to the accompanying drawings. For the sake of brief description with reference to the drawings, same or equivalent components may be provided with the same reference numbers, and description thereof may not be repeated.

The terms used herein are for the purpose of describing particular arrangements and embodiments only and are not intended to be limiting of example arrangements and embodiments. As used herein, the singular forms "a", "an" and "the" are intended to include the plural forms as well, unless the context clearly indicates otherwise.

In the present disclosure, a cooling compartment (or a cooling chamber) refers to a chilling compartment or a freezing compartment and an ultra-low temperature compartment refers to a space in which a food item can be stored at a temperature lower than that of the freezing compartment, and which can be maintained at a temperature lower than −40° C.

Figure 1:
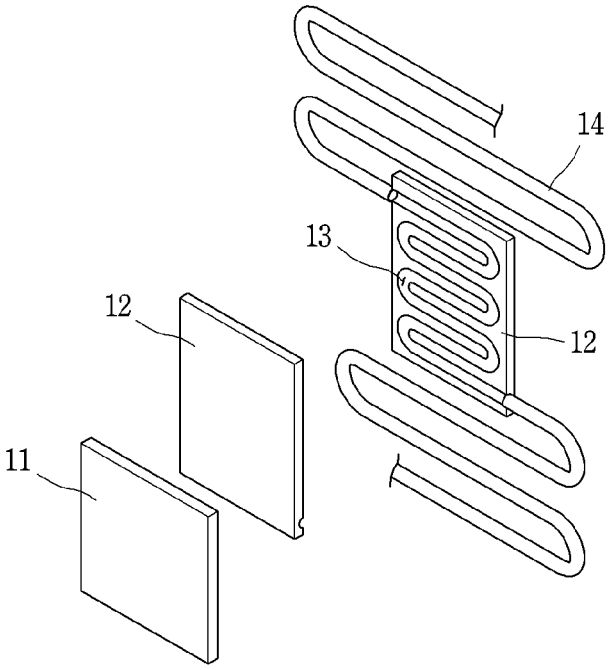
FIG. 1 is a conceptual view illustrating an evaporation part for a heat conduction unit (or a heat conduction unit evaporation part) for cooling a thermoelectric element.

FIG. 1 is a conceptual view illustrating an evaporation part for a heat conduction unit (or a heat conduction unit evaporation part) for cooling a heating surface of a thermoelectric element.

A refrigerant flow channel 13 allowing a refrigerant to flow therein is provided within a heat conduction unit evaporation part 12 (or heat conduction device) in a zigzag manner. Part of a refrigerant pipe of an evaporator 14 is cut and one end portion of the cut refrigerant pipe is connected to an inlet of the refrigerant flow channel 13 and the other end portion of the refrigerant pipe is connected to an outlet of the refrigerant flow channel 13.

One side of a heat conduction unit evaporation part 12 is in contact with a heating surface of the thermoelectric element 11 and heat emitted from the heating surface is transmitted to a refrigerant flowing at the other side of the heat conduction unit evaporation part 12, thus cooling the heating surface of the thermoelectric element 11.

A temperature of the ultra-low temperature compartment may be decreased to a difference in temperature between the heating surface of the thermoelectric element 11 and a heat absorption surface from a refrigerant temperature of the evaporator 14.

A temperature realized in the ultra-low temperature compartment may vary depending on how much heat emitted from the heating surface of the thermoelectric element 11 is transmitted through the heat conduction unit evaporation part 12, and thus heat dissipation performance of the heat conduction unit evaporation part 12 is very important.

The heating surface of the thermoelectric element 11 is different in surface temperature. The reason is because outer edge portions of the thermoelectric element 11 are in contact with ambient air so as to be cooled, while a central portion thereof is surrounded by the peripheral portions, without being in contact with ambient air, and having a temperature higher than that of the outer edges.

However, as for the refrigerant flow channel of the heat conduction unit evaporation part 12, since the inlet of a refrigerant is positioned at the lower end portion of the heat conduction unit evaporation part 12 and the outlet of the refrigerant is positioned at the upper end portion of the heat conduction unit evaporation part 12, the inlet side refrigerant having a relatively low temperature is heat-exchanged with the lower end portion of the heat conduction unit evaporation part 12 having a relatively low temperature and subsequently heat-exchanged with the central portion of the heat conduction unit evaporation part 12 having a relatively high temperature. This may lead to a problem that heat-exchange efficiency of the refrigerant is lowered and performance of heat dissipation of the heat conduction unit evaporation part 12 is degraded.

Figure 2:
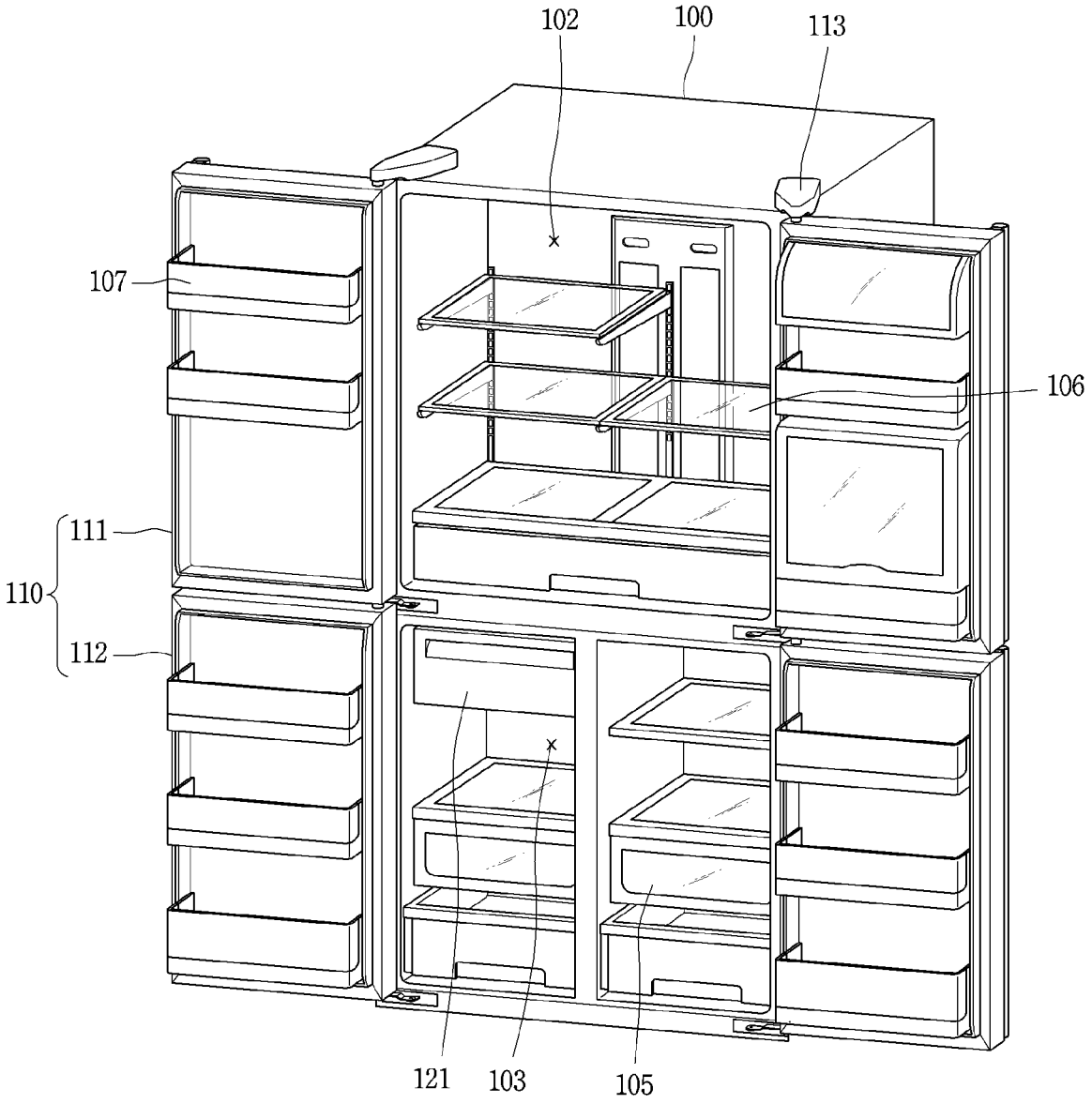
FIG. 2 is a perspective view of a refrigerator related to the present disclosure.

FIG. 2 is a perspective view of a refrigerator. Other arrangements may also be provided.

An appearance of the refrigerator is formed by a main body 100 and a door 110.

The main body 100 may include an outer case and an inner case.

The outer case may form an appearance of portions of the refrigerator excluding a front portion of the refrigerator formed by the door 110.

In FIG. 2, a bottom freezer type refrigerator in which a chilling compartment 102 is provided in an upper portion of the main body 100 and a freezing compartment 103 is provided in a lower portion thereof is shown. However, the present arrangements is not limited thereto and may also be applied to a side-by-side type refrigerator in which the chilling compartment 102 and the freezing compartment 103 are disposed left and right, and/or a top mount type refrigerator in which the freezing compartment 103 is disposed above the chilling compartment 102.

A heat exchange chamber 101 may accommodate an evaporator 134.

For example, a cold air discharge duct may be installed on a rear wall of the freezing compartment 103. The heat exchange chamber 101 may supply cold air to the freezing compartment 103 and may be provided in a space visually covered by the cold air discharge duct.

A freezing compartment fan 104 (FIG. 17) and the evaporator 134 may be installed in the heat exchange chamber 101, and the evaporator 134 heat-exchanges air and a refrigerant to generate cold air and the freezing compartment fan 104 forms flow of cold air.

Components of the heat exchange chamber 101, a fan, and a cold air discharge opening 101*a* provided in the freezing compartment 103 may also be applied to supply cold air to the chilling compartment 102.

The door 110 may include a chilling compartment door 111 for opening and closing the chilling compartment 102 and a freezing compartment door 112 for opening and closing the freezing compartment 103 depending on an installation position.

A drawer 105 is configured to form a space separated from other spaces of a food storage to store a food item. The drawer 105 may be configured to slidably move and may be inserted into the food storage or drawn out therefrom through slidable movement.

A refrigerating cycle system is provided within the main body 100. The refrigerating cycle system includes a compressor 131, a condenser 132, an expansion device 133 (capillary, etc.) and an evaporator 134.

Figure 3:
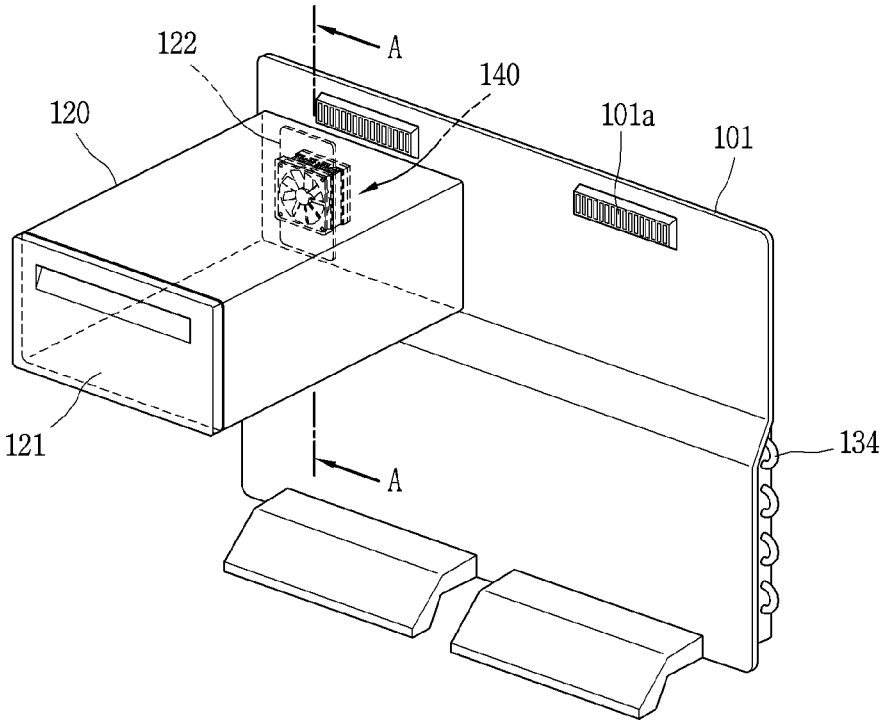
FIG. 3 is a conceptual view illustrating an ultra-low temperature compartment disposed in a freezing compartment of FIG. 2.
Figure 4:
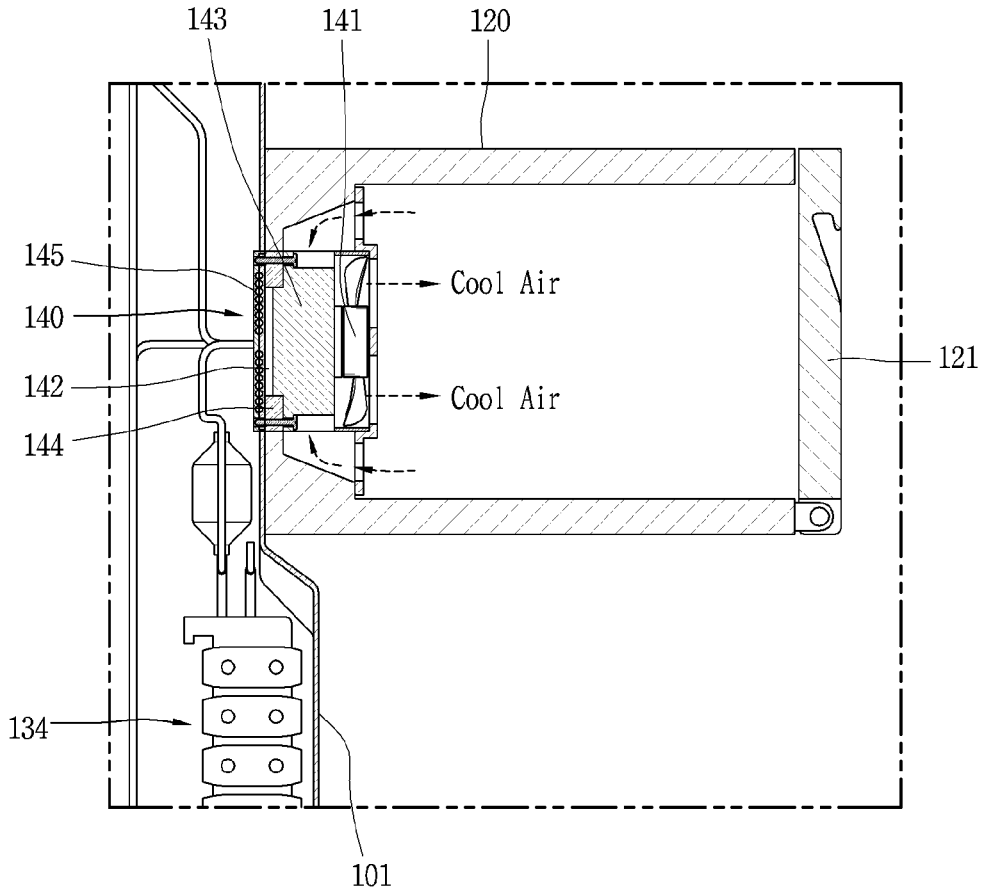
FIG. 4 is a cross-sectional view taken along line A-A of FIG. 3.
Figure 5:
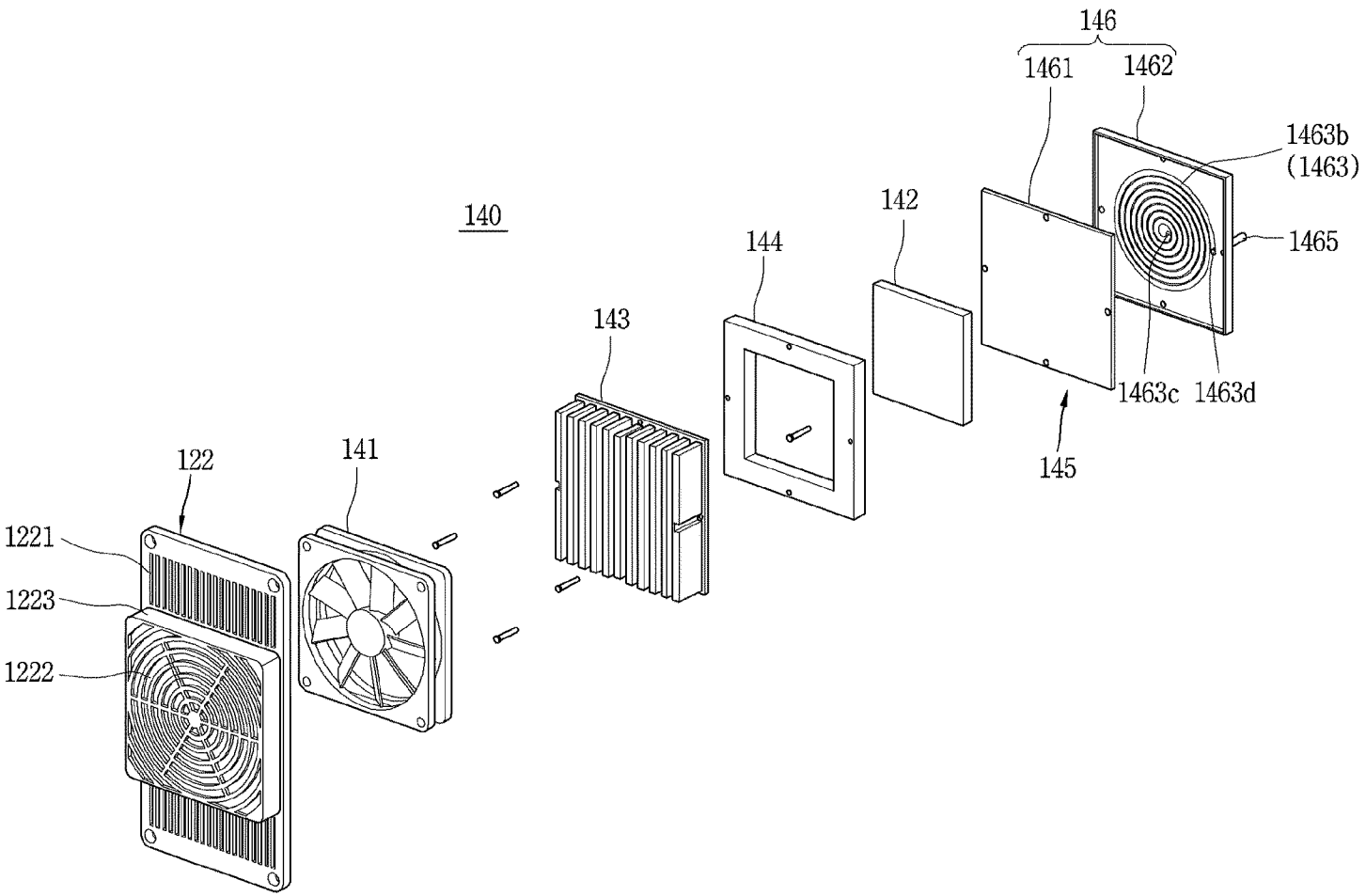
FIG. 5 is an exploded perspective view illustrating an ultra-low temperature cooling module of FIG. 4.
Figure 6:
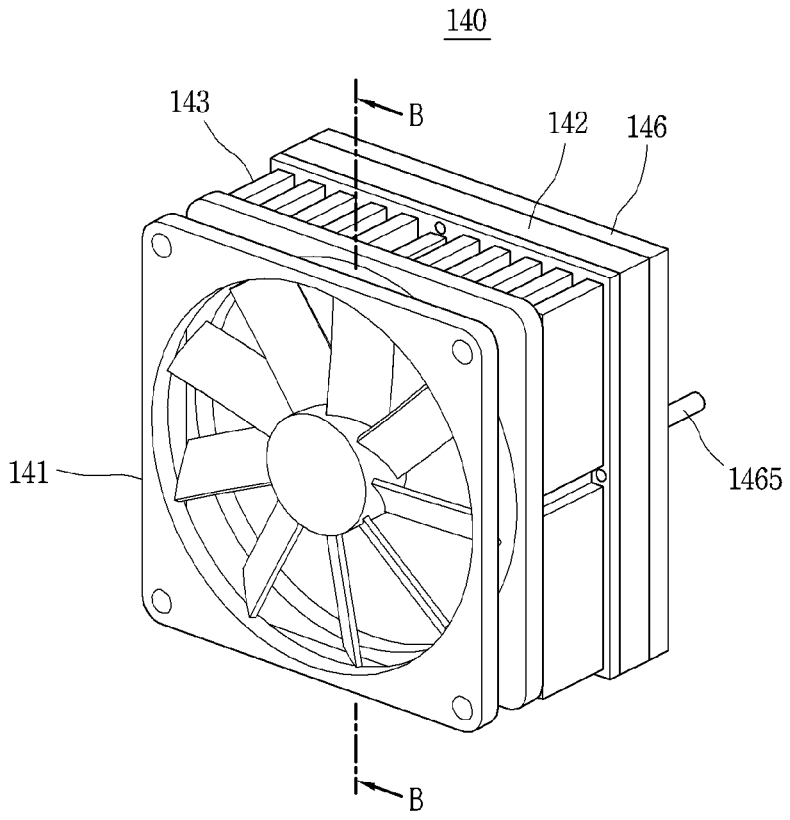
FIG. 6 is an assembly view illustrating the ultra-low temperature cooling module of FIG. 4.
Figure 7:
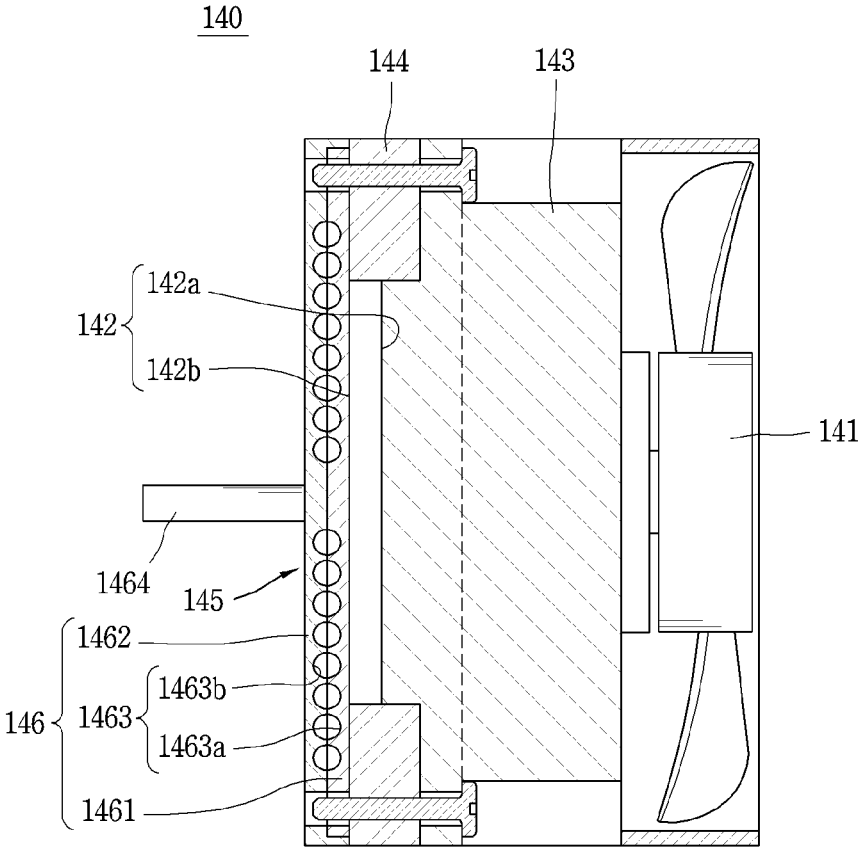
FIG. 7 is a cross-sectional view taken along line B-B of FIG. 6.

FIG. 3 is a conceptual view illustrating an ultra-low temperature compartment disposed in a freezing compartment of FIG. 2. FIG. 4 is a cross-sectional view taken along line A-A of FIG. 3. FIG. 5 is an exploded perspective view illustrating an ultra-low temperature cooling module of FIG. 4. FIG. 6 is an assembly view illustrating the ultra-low temperature cooling module of FIG. 4. FIG. 7 is a cross-sectional view taken along line B-B of FIG. 6. Other arrangements may also be provided.

The ultra-low temperature compartment 120 is installed to be attached to a front side of the heat exchanger chamber 101. The ultra-low temperature compartment 120 may have a rectangular parallelepiped box shape opened forwardly and backwardly. A rear side of the ultra-low temperature compartment 120 may be connected, in a communicating manner, to the heat exchange chamber 101. The ultra-low temperature compartment 120 may have an insulator to block heat transmission from the outside.

A drawer assembly 121 may be accommodated in and drawn in and out from the ultra-low temperature compartment 120. The drawer assembly 121 may have a box shape opened in an upward direction, and food items such as meat, and/or the like, may be stored within the drawer assembly 121.

At least a portion of an ultra-low temperature cooling module 140 (or ultra-low temperature cooling device) may be provided within the ultra-low temperature compartment 120. The ultra-low temperature cooling module 140 may cool the ultra-low temperature compartment 120 to maintain the ultra-low temperature compartment 120 at a preset temperature. The ultra-low temperature cooling module 140 may be disposed on a rear portion of the ultra-low temperature compartment 120, and the rear portion of the ultra-low temperature cooling module 140 may be heat-exchanged with cold air flowing along a cold air flow channel of the heat exchange chamber 101.

A cooling cover 122 may be installed on a rear side of the drawer assembly 121. A fan accommodation part 1223 may be provided in the cooling cover 122, and the cooling fan 141 may be accommodated within the fan accommodation part 1223. The fan accommodation part 1223 may protrude to corresponding to the cooling fan 141 in the cooling cover 122 and cover the cooling fan 141. A plurality of cold air discharge holes 1222 extending in a circumferential direction are disposed concentrically on a front side of the fan accommodating part 1223. Cold air is discharged from a rear side of the cooling cover 122 to the inside of the drawer assembly 121 through the plurality of cold air discharge holes 1222.

A plurality of thin cold air intake holes 1221 extending in a vertical direction may be provided on the cooling cover 122. The plurality of cold air intake holes 1221 are disposed to be spaced apart from each other in upper and lower portions of the cooling cover 122 with the plurality of cold air discharge holes 1222 interposed therebetween, respectively. Cold air may be intaken from the inside of the drawer assembly 121 to a rear side of the cooling cover 122 through the plurality of cold air intake holes 1221.

The cooling cover 122 may divide the ultra-low temperature compartment 120 into a first accommodation part for accommodating the ultra-low temperature cooling module 140 (or ultra-low temperature cooling device) and a second accommodation part for accommodating the drawer assembly 121.

The ultra-low temperature cooling module 140 may include a cooling fan 141, a cold sink 143 (or cold sink device), a thermoelectric element 142, an insulator 144, and an evaporation part 145 for a heat conduction unit (or a heat conduction unit evaporation part 145). The cooling fan 141, the cold sink 143, the thermoelectric element 142, the insulator 144, and the heat conduction unit evaporation part 145 may be disposed on the rear side of the cooling cover 122. The heat conduction unit evaporation part 145 may also be called an evaporation device.

The cooling fan 141 may be disposed to face the cooling cover 122 on the rear side of the cooling cover 122, and in order to allow air within the drawer assembly 121 to be heat-exchanged with the cold sink 143, the cooling fan 141 may intake internal air of the drawer assembly 121 to the cold sink 143 through the cold intake holes 1221. The cooling fan 141 may blow cold air cooled by the cold sink 143 to the inside of the drawer assembly 121.

The cold sink 143 may be formed of a metal that is thermally conducted such as aluminum, and/or the like. A rear side of the cold sink 143 is in contact with a heat absorption surface 142*a* of the thermoelectric element 142 so as to be cooled by the thermoelectric element 142. A plurality of heat exchange fins may be provided on a front side of the cold sink 143 and extend in a vertical direction. The plurality of heat exchange fins are spaced apart from each other in a horizontal direction to expand an area of a heat exchange of the cold sink 143 with air intaken through the cold air intake hole 1221. The plurality of heat exchange pins may be integrally formed with the cold sink 143.

The thermoelectric element 142 is an element using the Peltier effect. The Peltier effect may refer to a phenomenon that when a DC voltage is applied to both ends of two different elements, one side may absorb heat and the other side may generate heat according to a direction of a current. Since heat absorption occurs on the front side facing the cold sink 143, among both sides of the thermoelectric element 142, the front side may be referred to as a heat absorption surface 142*a*, and since heat is generated from the rear side facing the heat conduction unit evaporation part 145, the rear side may be referred to as a heating surface 142*b*.

The heat absorption surface 142*a* of the thermoelectric element 142 may be disposed toward the cooling cover 122 and may be in contact with the rear side of the cold sink 143 to cool the cold sink 143. The heating surface 142*b* of the thermoelectric element 142 may be in contact with the front side of the heat conduction unit evaporation part 145, so that heat emitted from the heating surface 142*b* is heat-exchanged with the heat conduction unit evaporation part 145 and transmitted to a refrigerant flowing within the heat conduction unit evaporation part 145.

In the ultra-low temperature cooling module 140, the cold sink 143 may be cooled using a heat absorption phenomenon of the thermoelectric element 142, air within the drawer assembly 121 may be intaken to the cold sink by driving the cooling fan 141, and air within the drawer assembly 121 may be cooled to an ultra-low temperature through heat exchange between the intaken air and the cold sink 143, whereby a food item kept in the drawer assembly 121 can be quickly cooled to an ultra-low temperature.

According to the ultra-low temperature cooling module 140, the cold sink 143, the thermoelectric element 142, and the heat conduction unit evaporation part 145 may be in contact with each other. When a voltage is applied to the thermoelectric element 142, heat is moved from the heat absorption surface 142*a* to the heating surface 142*b* within the thermoelectric element 142, and heat is transmitted from the cold sink 143 in contact with the heat absorption surface 142*a* on an outer side of the thermoelectric element 142 to the heat conduction unit evaporation part 145 in contact with the heating surface 142*b*, thus cooling a food item kept in the drawing assembly 121.

The thermoelectric element 142 may be smaller than the cold sink 143 and the heat conduction unit evaporation part 145, forming a space between the cold sink 143 and the heat conduction unit evaporation part 145. Heat may be transmitted from the outside to the heat absorption surface 142*a* of the thermoelectric element 142, causing a temperature of the heat absorption surface 142*a* to be increased unintentionally.

In order to solve the problem, the insulator 144 may be disposed between the cold sink 143 and the heat conduction unit evaporation part 145 to surround an outer circumferential portion of the thermoelectric element 142. The insulator 144 may serve to prevent transmission of external heat to the heat absorption surface 142*a* of the thermoelectric element 142.

In a state in which the cold sink 143, the thermoelectric element 142, and the heat conduction unit evaporation part 145 are in contact with each other, the cold sink 143, the insulator 144, and the heat conduction unit evaporation part 145 may be coupled by a fastening element such as a screw, and/or the like. In a state in which the cold sink 143, the insulator 144, and the heat conduction unit evaporation part 145 are sequentially disposed to be in contact with each other backwardly, four screws may penetrate through four portions of upper, lower, left, and right edge portions of the cold sink 143, the insulator 144, and the heat conduction unit evaporation part 145 to couple them into a single assembly.

Referring to FIG. 4, the heat conduction unit evaporation part 145 may communicate with the heat exchange chamber 101 through a communication hole formed in the heat exchange chamber 101. A freezing compartment fan 104 (see FIG. 17) and the evaporator 134 are provided within the heat exchanger chamber 101, and the freezing compartment fan 104 may blow cold air toward the heat conduction unit evaporation part 145. The heat conduction unit evaporation part 145 may be cooled by cold air from the heat exchange chamber 101.

Figure 8:
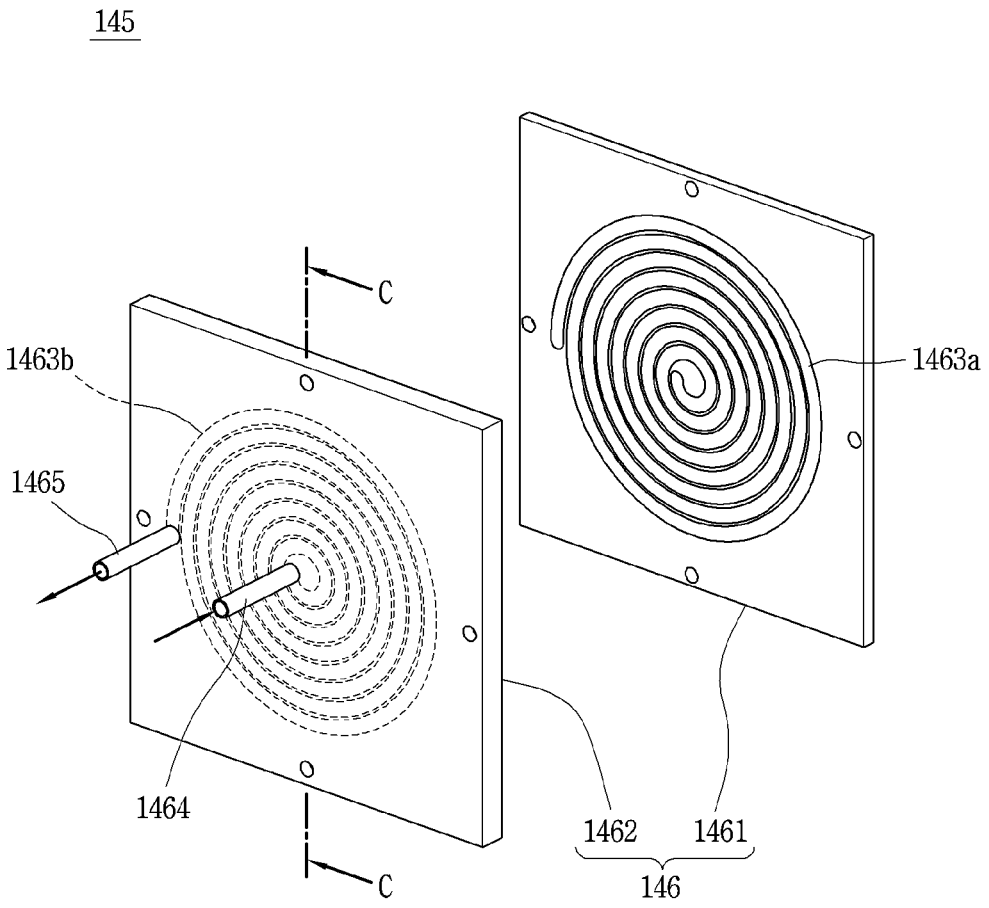
FIG. 8 is a conceptual view illustrating a configuration in which a refrigerant flow channel is formed within a heat conduction unit evaporation part according to a first embodiment.
Figure 9:
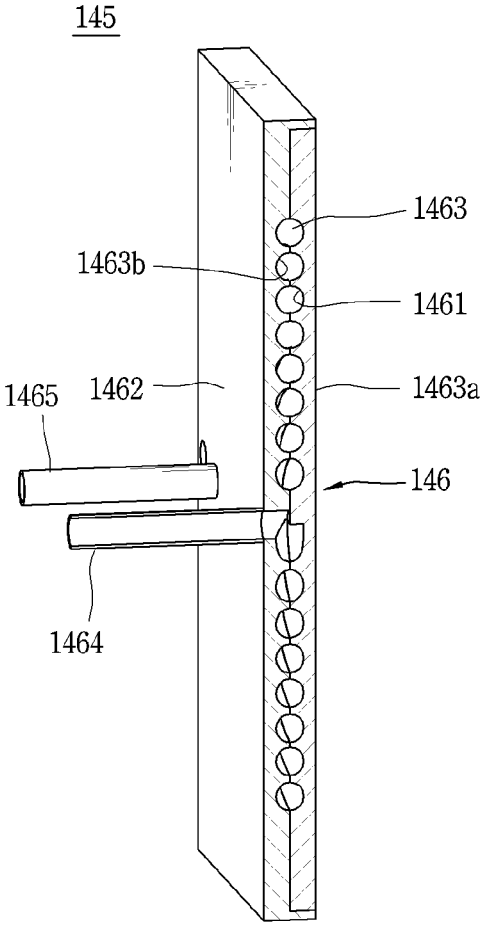
FIG. 9 is a conceptual view illustrating a configuration in which first and second heat exchange plates of FIG. 8 are assembled.
Figure 10:
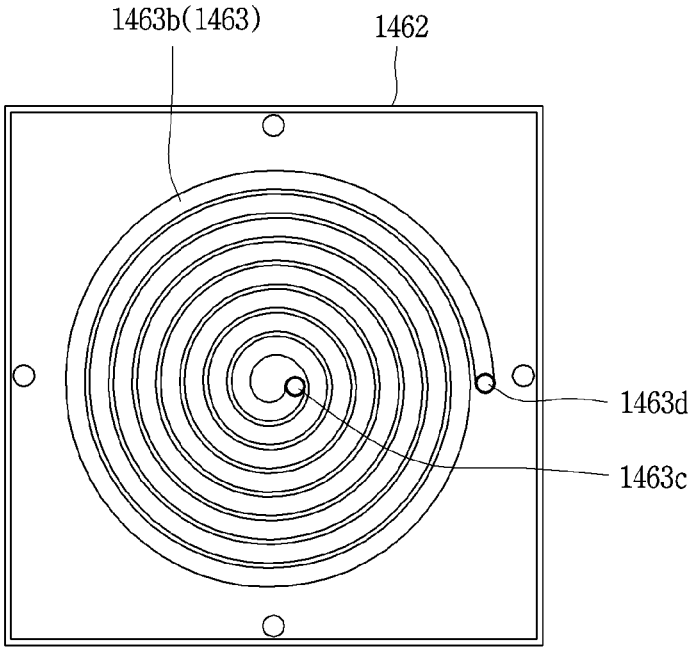
FIG. 10 is a conceptual view illustrating a configuration in which a refrigerant flow channel is formed on an inner side of the first heat exchange plate in FIG. 9.

FIG. 8 is a conceptual view illustrating a configuration in which a refrigerant flow channel 1463 is formed within the heat conduction unit evaporation part 145 according to a first embodiment. FIG. 9 is a conceptual view illustrating a configuration in which first and second heat exchange plates 1461 and 1462 of FIG. 8 are assembled. FIG. 10 is a conceptual view illustrating a configuration in which a refrigerant flow channel 1463 is formed on an inner side of the first heat exchange plate 1461 in FIG. 9. Other embodiments and configurations may also be provided.

The heat conduction unit evaporation part 145 (or evaporation device) is configured to cool the heating surface 142*b* of the thermoelectric element 142 using a refrigerant. In the heat conduction unit evaporation part 145, a plurality of heat exchange plates 146 are coupled to be in contact with each other.

The heat conduction unit evaporation part 145 shown in FIG. 8 may include a first heat exchange plate 1461 and a second heat exchange plate 1462.

The first and second heat exchange plates 1461 and 1462 may be separately designed and coupled or may be integrally formed.

A part of the first heat exchange plate 1461 may be disposed on the heating surface 142*b* of the thermoelectric element 142 so as to be in contact with the heating surface 142*b*. A first refrigerant flow channel recess 1463*a* may be formed on an inner surface of the first heat exchange plate 1461.

A refrigerant flow channel recess may be formed on only on one surface of any one of the first and second heat exchange plates 1461 and 1462, or may be separately formed in the first and second heat exchange plates 1461 and 1462 and disposed to face each other to form a single refrigerant flow channel 1463.

A refrigerant piping may directly be formed within the heat conduction unit evaporation part 145, or may be formed to be in contact with an outer side of the heat conduction unit evaporation part 145.

The refrigerant flow channel 1463 may have a coil shape.

A refrigerant intake port 1464 or a refrigerant discharge port 1465 may be formed on one surface of the heat exchange plate 146. The refrigerant intake port 1464 and the refrigerant discharge port 1465 may protrude to be perpendicular to the rear surface of the second heat exchange plate 1462. The refrigerant intake port 1464 may be connected to communicate with a refrigerant pipe of the evaporator by a refrigerant pipe 137. The refrigerant discharge port 1465 may be connected to the compressor 131 by the refrigerant pipe 137.

Since surface temperatures of the heating surface 142*b* of the thermoelectric element 142 are different, a refrigerant inlet 1464 of the heat conduction unit evaporation part 145 is preferably installed in a portion of the heating surface 142*b* of the thermoelectric element 142 where a surface temperature is highest or a position adjacent thereto.

Since a surface temperature of a central portion of the heating surface 142*b* of the thermoelectric element 142 is higher than a temperature of a peripheral portion thereof, the refrigerant inlet 1464 is preferably designed in a position corresponding to the central portion of the thermoelectric element 142.

Since surface temperatures of the heat conduction unit evaporation part 145 heat-exchanged with the thermoelectric element 142 are different, the refrigerant inlet 1464 is preferably installed in a portion of the heat conduction unit evaporation part 145 where a surface temperature is highest (or a portion adjacent thereto).

Since a surface temperature of the heat conduction unit evaporation part 145 is higher in a central portion than in a peripheral portion, the refrigerant inlet 1464 is preferably designed in a position corresponding to the central portion of the heat conduction unit evaporation part 145.

Even when the refrigerant inlet 1464 is formed in a position corresponding to a peripheral portion of the thermoelectric element 142 or the heat conduction unit evaporation part 145, it may be designed such that a refrigerant is first introduced to a central portion of the thermoelectric element 142 or the heat conduction unit evaporation part 145 and subsequently flows out to the peripheral portion.

It may be designed such that density of refrigerant pipes of the thermoelectric element 142 or the heat conduction unit evaporation part 145 is higher in the central portion thereof than in the peripheral portion thereof.

That is, in order to reach an ultra-low temperature by maximizing cooling efficiency of the heating surface of the thermoelectric element, it may be designed such that an amount of heat exchange between the central portion of the thermoelectric element 142 and the heat conduction unit evaporation part 145 per unit area is larger than an amount of heat exchange between the peripheral portion of the thermoelectric element 142 and the heat conduction unit evaporation part 145.

The refrigerant flow channel 1463 may have a radius of curvature increased from a refrigerant inlet 1463*c* to a refrigerant outlet 1463*d*.

In examples where the first and second heat exchange plates 1461 and 1462 are separately designed and coupled, an accommodation protrusion may protrude from an edge portion of the second heat exchange plate 1462 in a thickness direction of the heat exchange plate 146 to surround an edge portion of the first heat exchange plate 1461. A sealing member may be inserted along an inner surface of the accommodation protrusion to seal a gap between the first and second heat exchange plates 1462.

Figure 11:
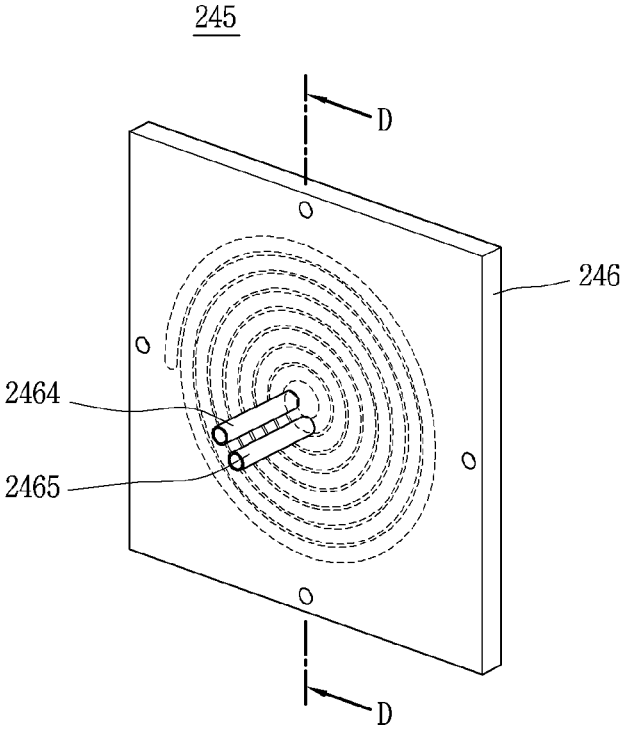
FIG. 11 is a solid view illustrating a heat conduction unit evaporation part according to a second embodiment.
Figure 12:
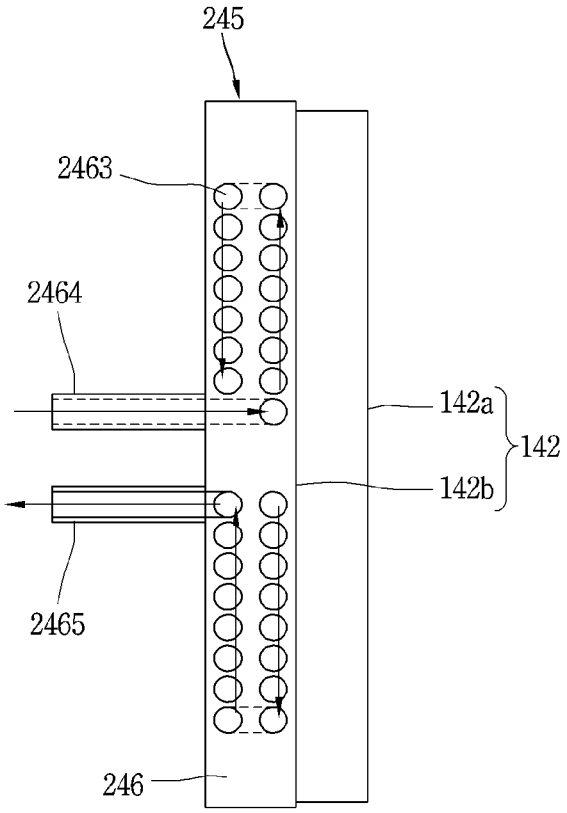
FIG. 12 is a cross-sectional view illustrating a movement path of a refrigerant in the heat conduction unit evaporation part of FIG. 11.
Figure 13:
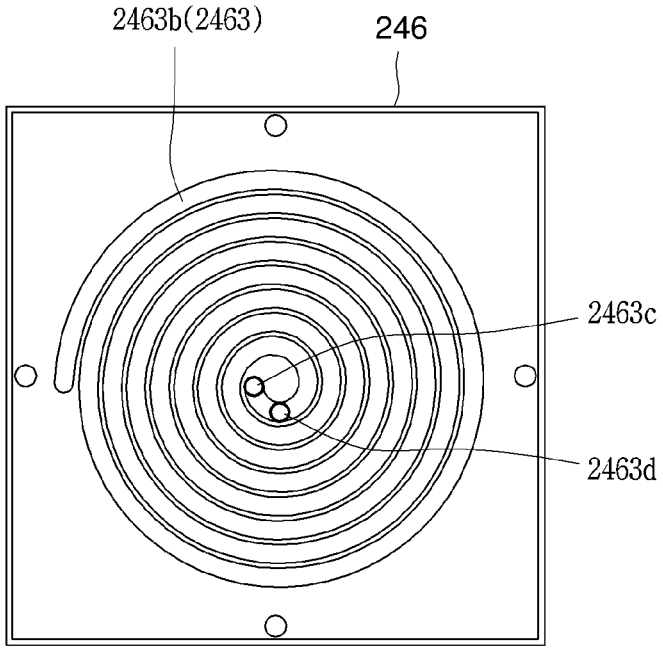
FIG. 13 is a conceptual view illustrating positions of a refrigerant inlet and a refrigerant outlet of a refrigerant flow channel of a second row among a plurality of rows of FIG. 12.

FIG. 11 is a solid view illustrating a heat conduction unit evaporation part 245 according to a second embodiment. FIG. 12 is a cross-sectional view illustrating a movement path of a refrigerant in the heat conduction unit evaporation part 245 of FIG. 11. FIG. 13 is a conceptual view illustrating positions of a refrigerant intake port 2464 and a refrigerant discharge port 2465 of a refrigerant flow channel 2463 of a second row among a plurality of rows of FIG. 12. Other embodiments and configurations may also be provided.

The refrigerant flow channel 2463 shown in FIG. 12 may be provided in two rows in a thickness direction of the heat exchange plate 246. The refrigerant flow channel 2463 in each of the plurality of rows may have a coil shape. The refrigerant flow channels are connected to communicate with each other in an outer edge portion of the heat exchange plate 146.

The refrigerant intake port 2464 and the refrigerant discharge port 2465 may be positioned to be adjacent to each other. Referring to FIG. 11, the refrigerant intake port 2464 may be formed in a central portion of the heat exchange plate 246, and the refrigerant discharge port 2465 may be spaced apart from the refrigerant intake port 2464 in a diagonal direction right-downwardly.

A refrigerant pipe may directly be formed within the heat conduction unit evaporation part 245 or may be formed to be in contact with an outer side of the heat conduction unit evaporation part 245. Some rows of a plurality of refrigerant pipes may be formed on one surface of the heat conduction unit evaporation part 245 and the other rows of the plurality of refrigerant pipes may be formed on the other surface of the heat conduction unit evaporation part 245.

FIG. 13 illustrates a second row of refrigerant flow channel 2463*b* among the plurality of rows, in which a refrigerant inlet 2463*c* is formed in a central portion of the refrigerant flow channel 2463*b*, and the second row of refrigerant flow channel 2463*b* is connected to an end portion of an outer edge of a first row of refrigerant flow channel. A refrigerant outlet 2463*d* of the refrigerant flow channel 2463*b* is spaced apart from the refrigerant inlet 2463*c* in a diagonal direction right-downwardly and connected to a central portion of the first row of refrigerant flow channel.

A refrigerant intaken through the refrigerant intake port 2464 may be introduced to a central portion of the first row of refrigerant flow channel 2463 in a thickness direction of the heat exchange plate 246, move along the first row of refrigerant flow channel 2463 toward an outer edge portion of the heat exchange plate 246, move to the second row of refrigerant flow channel 2463*b* communicating with the first row of refrigerant flow channel 2463 from the outer edge portion of the heat exchange plate 246, move toward a central portion of the heat exchange plate 246 along the second row of refrigerant flow channel 2463*b*, and be subsequently discharged through the refrigerant discharge port 2465.

A front side of the heat exchange plate 246 may be in contact with the heating surface 142*b* of the thermoelectric element 142 and a refrigerant of the heat exchange plate 246 is heat-exchanged with the heating surface 142*b* of the thermoelectric element 142. Accordingly, heat emitted from the heating surface 142*b* of the thermoelectric element 142 is transmitted to the refrigerant.

Figure 14:
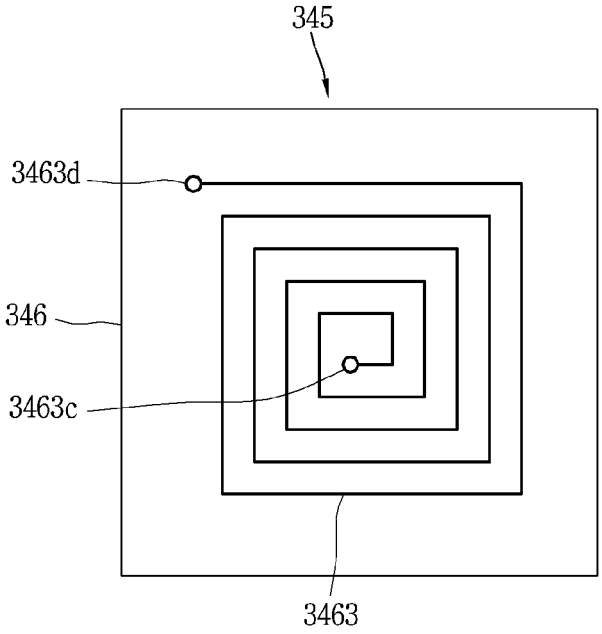
FIGS. 14 to 16 are conceptual views illustrating various embodiments of a refrigerant flow channel.
Figure 15:
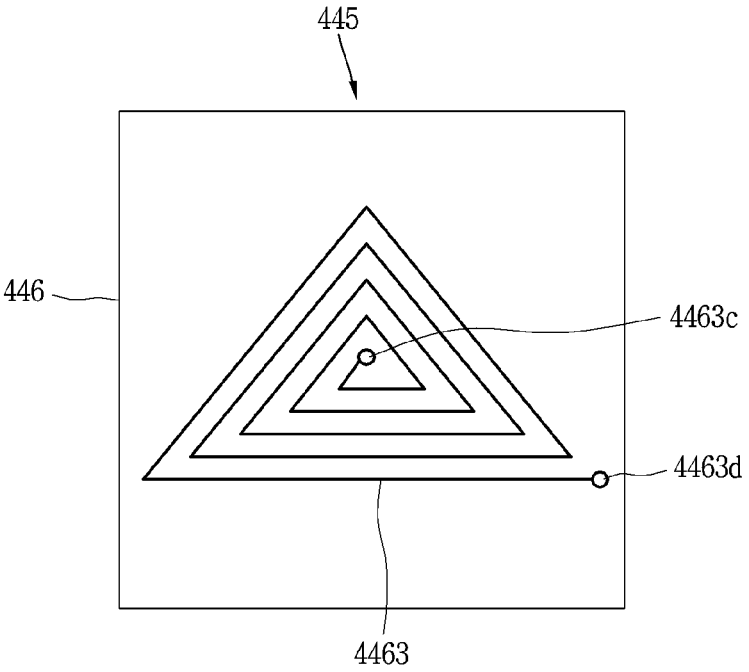
Figure 16:
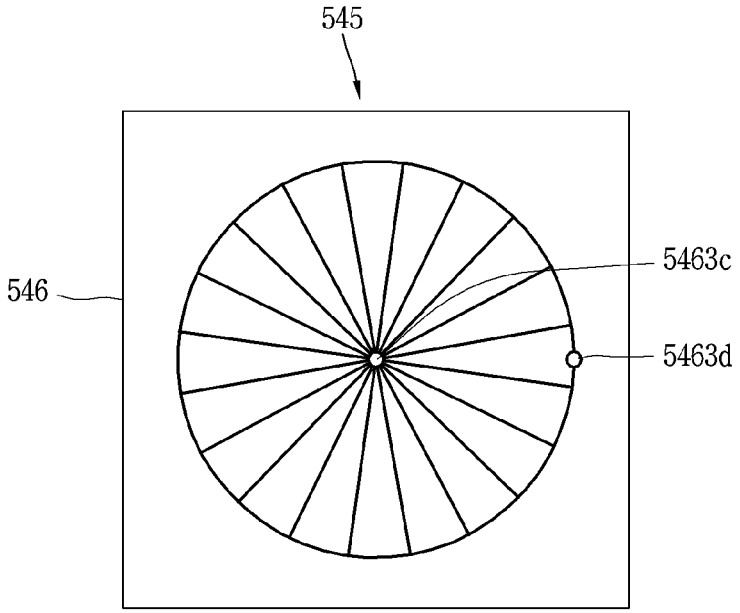

FIGS. 14 to 16 are conceptual views illustrating various embodiments of the refrigerant flow channel 1463. Other embodiments and configurations may also be provided.

A refrigerant flow channel 1463, 2463, 3463, 4463, or 5463 may be provided within the heat exchange plate 146, 246, 346, 446, or 546, respectively, and have various shapes such as a coil shape, a concentric circular shape, a polygonal shape, a radial shape, and the like.

FIG. 14 illustrates a quadrangular refrigerant flow channel 3463. The quadrangular refrigerant flow channel 3463 does not have a closed quadrangular shape, but has a shape in which a plurality of homocentric open quadrangles are continuously connected to each other such that lengths of respective sides thereof are gradually increased from the center of the heat exchange plate 346 toward outer edge portions thereof.

FIG. 15 illustrates a triangular refrigerant flow channel 4463. The triangular refrigerant flow channel 4463 does not have a closed quadrangular shape, but has a shape in which a plurality of homocentric open quadrangles are continuously connected to each other such that lengths of respective sides thereof are gradually increased from the center of the heat exchange plate 446 toward outer edge portions thereof.

FIG. 16 illustrates a radial refrigerant flow channel 5463. The radial refrigerant flow channel 5463 includes a refrigerant inlet 5463*c* formed at a central portion of a heat exchange plate 546, an outer flow channel part formed at an outer edge portion of the heat exchange plate 546 in a circumferential direction, an inner flow channel part extending from the refrigerant inlet 5463*c* toward the outer flow channel part in a radial direction, and a refrigerant outlet 5463*d* formed on one side of the outer flow channel part. According to the radial refrigerant flow channel 5463, a refrigerant may move from the refrigerant inlet 5463*c* positioned at the central portion of the heat exchange plate 546 in a radial direction along the inner flow channel part, may move along the outer flow channel part, and may be subsequently discharged from the refrigerant outlet 5463*d* to the outside of the heat exchange plate 146.

In defining a shape of the refrigerant flow channel 1463, a concentric circular shape has a concept of a coil shape.

In the refrigerant flow channel 1463, a refrigerant may be introduced to a central portion of the heat exchange plate 146 and move to an outer edge portion of the heat exchange plate 146 to enhance heat dissipation performance of the heat conduction unit evaporation part 145. Thus, the refrigerant flow channel 1463 may have various other shapes in addition to a concentric circular shape, a polygonal shape, and a radial shape.

The refrigerant flow channel 1463 may have a coil shape in which movement resistance of a refrigerant can be minimized.

Figure 17:
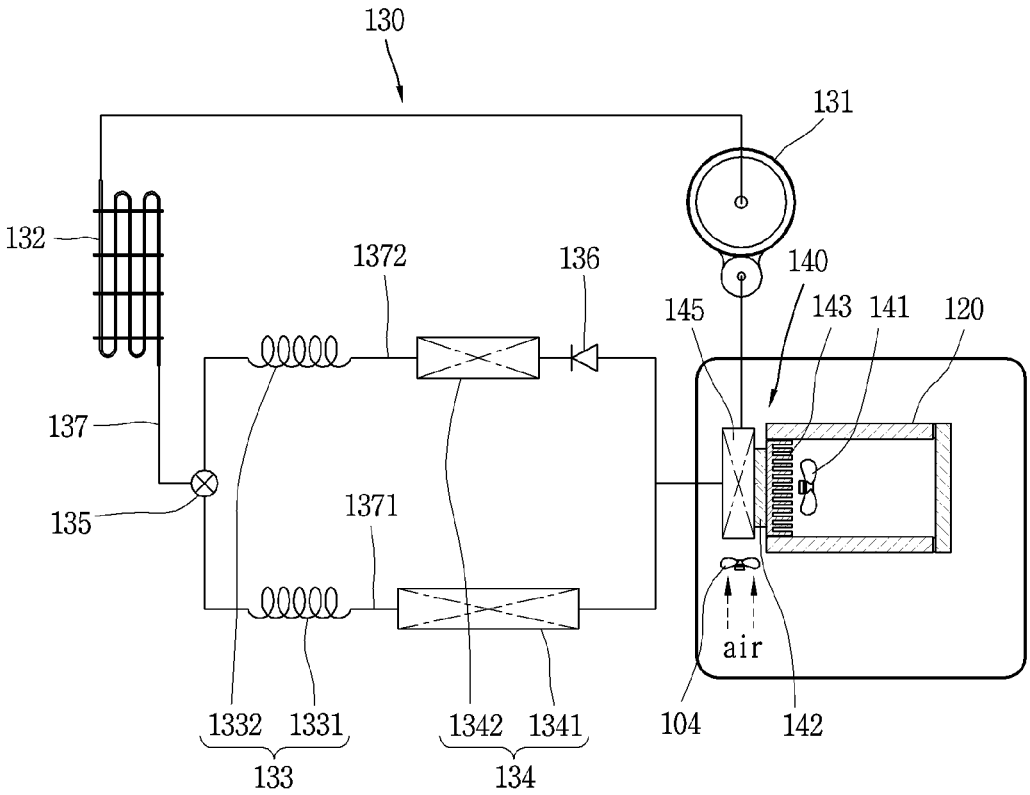
FIG. 17 is a conceptual view illustrating a flow of a refrigerant used in a heat conduction unit evaporation part.

FIG. 17 is a conceptual view illustrating a flow of a refrigerant used in the heat conduction unit evaporation part 145. Other embodiments and configurations may also be provided.

The evaporator 134 may include a freezing compartment evaporator (or a first evaporator) 1341 provided in the heat exchange chamber 101 of the freezing compartment 103 and providing cold air to the freezing compartment and a chilling compartment evaporator (or a second evaporator) 1342 provided in the heat exchange chamber 101 of the chilling compartment 102 and providing cold air to the chilling compartment 102. The first and second evaporators 1341 and 1342 are connected in parallel by a refrigerant pipe 137. The chilling compartment evaporator 1342 and the freezing compartment evaporator 1341 may be referred to as the evaporator 134 unless they are discriminatedly mentioned (e.g., first evaporator 1341 and second evaporator 1342).

A two-way valve 135 or a three-way valve 135 may be provided at a spot from which the first evaporator 1341 and the second evaporator 1342 are branched from the condenser 132, to distribute a flow amount of a refrigerant provided to the first and second evaporators 1341 and 1342. In the example of the two-way valve 135, the refrigerant may be selectively supplied to the first and second evaporators 1341 and 1342.

A capillary, the expansion device 133, may include a first capillary 1331 and a second capillary 1332. The first capillary 1331 may be installed in a first branch pipe 1371 extending from the three-way valve 135 to the first evaporator 1341, and the second capillary 1332 may be installed in a second branch pipe 1372 extending from the three-way valve 135 to the second evaporator 1342.

The compressor 131 may include a first compressor 1311 and a second compressor (not shown) provided within the main body 100. The first compressor 1311 may be provided within the heat exchange chamber 101 on the rear side of the freezing compartment 103. The first compressor 1311 may be connected to the first evaporator 1341, compress a refrigerant discharged from the first evaporator 1341 and circulate the refrigerant.

The second compressor (not shown) may be provided within the heat exchange chamber 101 on the rear side of the chilling compartment 102. The second compressor (not shown) may be connected to the second evaporator 1342, compress a refrigerant discharged from the second evaporator, and circulate the refrigerant.

A refrigerating cycle system 130 shown in FIG. 17 may include one compressor 131 and two evaporators 134.

The condenser 134 may be disposed at a rear end (on a downstream side) of the compressor 131, the three-way valve 135 may be disposed at a spot from which the rear end (downstream side) of the condenser 132 is bifurcated, the first capillary 1331 and the first evaporator 1341 may be installed in the first branch pipe 1372 branched from the three-way valve 135, and the second capillary 1332 and the second evaporator 1342 may be installed at the second branch pipe 1372. A check valve 135 may be installed at a rear end of the second evaporator 1342 to prevent a refrigerant discharged from the first evaporator 1341 from flowing backward to the second evaporator 1342.

The heat conduction unit evaporation part 145 may be connected in series to the evaporator 134. The heat conduction unit evaporation part 145 may be disposed successively together with the evaporator 134 along the refrigerant pipe 137.

Referring to a movement path of a refrigerant, the refrigerant may undergo a compression, condensation, expansion, and evaporation process, while circulating the compressor 131, the condenser 132, the expansion device 133, and the evaporator 134, and refrigerants discharged from the chilling compartment evaporator 1342 and from the freezing compartment evaporator 1341 join to be introduced to the refrigerant flow channel 1463 of the heat conduction unit evaporation part 145. The refrigerant discharged from the refrigerant flow channel 1463 of the heat conduction unit evaporation part 145 may be introduced again to the compressor 131 and continue to undergo the compression, condensation, expansion, and evaporation process and circulate repeatedly.

Heat emitted from the heating surface 142*b* of the thermoelectric element 142 may be heat-exchanged with a refrigerant from the heat conduction unit evaporation part 145 in contact with the heating surface 142*b* of the thermoelectric element 142 and transmitted to the refrigerant. Due to a difference in temperature between the heating surface 142*b* and the heat absorption surface 142*a* of the thermoelectric element 142, the heat absorption surface 142*a* of the thermoelectric element 142 is cooled to have an ultra-low temperature and the drawer assembly 121 of the ultra-low temperature compartment 120 is cooled through heat exchange between the heat absorption surface 142*a* and air of the ultra-low temperature compartment 120.

One side of the heat conduction unit evaporation part 145 is heat-exchanged with the heating surface 142*b* of the thermoelectric element 142 through conduction, and the other side thereof is heat-exchanged with a refrigerant within a refrigerant pipe formed therein or on a surface thereof through conduction. The heat conduction unit evaporation part 145 may be cooled through heat-exchange with cold air blown by the second fan 104 (i.e., the freezing compartment fan) disposed within the heat-exchange chamber 101. Accordingly, heat emitted from the heating surface 142*b* of the thermoelectric element 142 may be transmitted to cold air of the heat exchange chamber 101, as well as to the refrigerant flowing along the refrigerant flow channel 1463 of the heat conduction unit evaporation part 145, further increasing heat dissipation efficiency.

According to the first embodiment, since the heat conduction unit evaporation part 145 is connected to the evaporator 134 in series, any one of the chilling compartment 102, the freezing compartment 103, and the cooling compartment (chilling compartment 102 and the freezing compartment 103 may be called cooling compartment) and the ultra-low temperature compartment 120 may be simultaneously operated or only the ultra-low temperature compartment 120 may be operated alone.

The embodiment of FIG. 14 may have the following advantages over disadvantageous arrangements.

In the refrigerating cycle (130;1comp. 2eva cycle) including one compressor and two evaporators, the chilling compartment evaporator 1372 and the freezing compartment evaporator 1371 are alternately operated by the refrigerant switching valve 135 (i.e., the two-way valve or three-way valve 135). That is, after a refrigerant is switched to the chilling compartment to cool the chilling compartment, when a temperature of the chilling compartment reaches a preset temperature, the refrigerant is switched to the freezing compartment to cool the freezing compartment. In either case where the refrigerant is switched to the chilling compartment or the freezing compartment, the refrigerant flows to the heat conduction unit evaporation part 145, and thus a rapid decrease in temperature of the ultra-low temperature compartment 120 may be prevented in spite of the alternate operations. In examples where both temperatures of the chilling compartment and the freezing compartment are equal to the preset temperature, inflow of cold air to the chilling compartment is blocked in the same manner as described, whereby evaporation capability for cooling the ultra-low temperature compartment 120 may be enhanced.

Supply of cold air to the cooling compartment may be blocked as follows. That is, a damper controlling inflow of cold air to the cooling compartment may be shut down, a blow fan (or cooling fan for cooling ultra-low temperature compartment 141) for an evaporator for cooling a cooling compartment may be stopped, or the refrigerant switching valve 135 may be switched so that the refrigerant may not flow to an evaporator for a cooling compartment in which a temperature is satisfied.

Thus, according to the heat conduction unit evaporation part 145, since the refrigerant flow channel 1463 is formed in a direction in which the refrigerant spreads from the central portion of the thermoelectric element 142 toward an outer side of the thermoelectric element 142, high heat exchange efficiency and heat dissipation performance may be maximized.

Through heat-exchange using the heat absorption surface 142*a* of the thermoelectric element 142, the heat conduction unit evaporation part 145, and the cooling fan 141, the ultra-low temperature compartment 120 may be cooled to a temperature equal to or lower than 40° C. A size of the heat conduction unit evaporation part 145 may be reduced.

Figure 18:
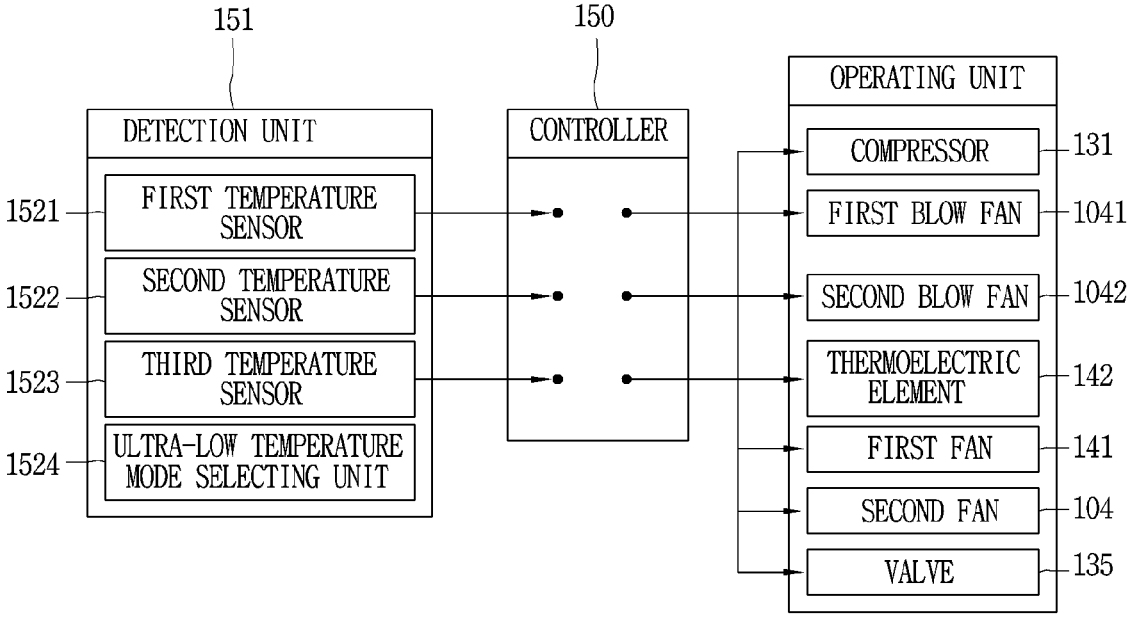
FIG. 18 is a block diagram illustrating a control device of a refrigerator.

FIG. 18 is a block diagram illustrating a control device of a refrigerator. Other embodiments and configurations may also be provided.

Referring to FIG. 18, the control device may include a detection unit 151, a controller 150, and an operating device (or operating unit).

The detection unit 151 (or detection device) may include a first temperature sensor 1521 for sensing a temperature of the chilling compartment, a second temperature sensor 1522 for sensing a temperature of the freezing compartment, a third temperature sensor for sensing a temperature of the ultra-low temperature compartment, and an ultra-low temperature mode selecting unit 1524 (or ultra-low temperature mode selecting device). The third temperature sensor 1523 may be provided within the ultra-low temperature compartment 120 to directly sense a temperature of the ultra-low temperature compartment 120 or may be provided in a portion of the ultra-low temperature cooling module 140 to indirectly calculate a temperature of the ultra-low temperature compartment 120. The third temperature sensor may be omitted.

The ultra-low temperature mode selecting unit 1524 may be operated such that a user may select an ultra-low temperature module. The ultra-low temperature compartment 120 may be set as default and a consumer may adjust only a set temperature.

A method for controlling a refrigerator may be described.

When the ultra-low temperature mode is selected, a temperature of the cooling compartment and a temperature of the ultra-low temperature compartment 120 are detected. When both the detected temperatures of the cooling chamber and the ultra-low temperature compartment are higher than a preset temperature (i.e., when both the detected temperatures are not satisfied), driving is performed to simultaneously cool both the cooling compartments 102 and 103 and the ultra-low temperature compartment. That is, the compressor 131 is driven, inflow of cold air to the cooling compartments 102 and 103 is allowed, and the thermoelectric element 142 and the first fan 141 are driven. In examples where blow fans 1041 and 1042 for the cooling chamber evaporator 134 and the blow fan 104 for the heat conduction unit evaporation part 145 are separately installed, the blow fans 1041, 1042, and 104 are driven. In examples where a damper for blocking inflow of cold air to the cooling compartments 102 and 103 is installed, the damper is controlled to be opened. When only temperatures of the cooling compartments 102 and 103 are satisfied, inflow of cold air to the temperature-satisfied cooling compartments 102 and 103 is blocked and driving is performed only to cool the ultra-low temperature compartment 120. That is, in cases where the blow fans 1041 and 1042 and the damper for the temperature-satisfied cooling compartments 102 and 103 are present, driving of the corresponding blow fans 1041 and 1042 is controlled to be stopped or the damper is controlled to be closed. In the example of a cycle in which two or more cooling compartment evaporators are connected to one compressor 131 in parallel, the refrigerant switching valve 135 may be switched to block inflow of a refrigerant to the temperature-satisfied cooling compartments 102 and 103. When a temperature of the ultra-low temperature compartment 120 is satisfied, cooling of the ultra-low temperature compartment 120 is terminated. That is, driving of the thermoelectric element 142 and the first fan 141 is terminated. Additionally, in examples where the blow fan 104 only for the heat conduction unit evaporation part 145 is present, driving of the corresponding blow fan is terminated.

According to another embodiment, when the ultra-low temperature mode is selected, temperatures of the cooling compartments 102 and 103 are detected, and when the detected temperatures of the cooling compartments 102 and 103 are not satisfied, driving is performed to simultaneously cool the cooling compartments 102 and 103 and the ultra-low temperature compartment 120. When the temperatures of the cooling compartments 102 and 103 are satisfied, driving starts to only cool the ultra-low temperature compartment 120. When the sum of a driving time for simultaneous cooling and a driving time for cooling the ultra-low temperature compartment 120 exceeds a predetermined time, cooling of the ultra-low temperature compartment 120 is terminated. The simultaneously cooling method and solely cooling method are the same as those of the first embodiment.

According to another embodiment, the function of simultaneously cooling the cooling compartments 102 and 103 and the ultra-low temperature compartment 120 may be released, whereby one of the cooling compartments 102 and 103 and the ultra-low temperature compartment 120 may set to be first driven according to set priority. For example, regarding the chilling compartment 102 and the ultra-low temperature compartment 120, the chilling compartment 102 is set to be preferentially cooled, and the freezing compartment 103 and the ultra-low temperature compartment 120 may be configured to be simultaneously cooled or cooled alone. The simultaneously cooling method and solely cooling method are the same as those of the first embodiment.

Thus, according to the method for controlling a refrigerator, through serial connection of the evaporator 134 and the heat conduction unit evaporation part 145, design of excessive evaporation capacity when the cooling compartment and the ultra-low temperature compartment 120 are simultaneously operated may be prevented. For example, in cases where a ratio of a required evaporation capacity for the chilling compartment and a required evaporation capacity of the heat conduction unit evaporation part 145 is the same as 70:30, a total evaporation capacity of the disadvantageous arrangements is designed to be 100, while that of the present disclosure may be designed to 70.

According to the method for controlling a refrigerator, when the chilling compartment and the ultra-low temperature compartment 120 are simultaneously operated, evaporation capacity may be effectively operated. Cooling loss made due to alternated operation of the chilling compartment and the ultra-low temperature compartment 120 as in the disadvantageous arrangement may be eliminated. An aspect of the detailed description is to provide a refrigerator in which heat exchange efficiency and heat dissipation performance of a heat conduction unit evaporation part are enhanced by installing a refrigerant inlet of the heat conduction unit evaporation part in a portion of a heating surface having a highest surface temperature of a thermoelectric element or in a portion adjacent thereto.

To achieve these and other advantages and in accordance with this specification, as embodied and broadly described herein, a refrigerator may include: a main body including a heat exchange chamber, a chilling compartment, a freezing compartment positioned to be adjacent to the chilling compartment and disposed in front of the heat exchange chamber, and an ultra-low temperature compartment disposed within the freezing compartment and maintained at a temperature lower than that of the freezing compartment; a chilling compartment door opening and closing the chilling compartment; a freezing compartment door opening and closing the freezing compartment; a drawer assembly accommodated in the ultra-low temperature compartment; an evaporator provided within the heat exchange chamber; a compressor allowing a refrigerant to flow to the evaporator; and an ultra-low temperature cooling module cooling air of the ultra-low temperature compartment, wherein the ultra-low temperature cooling module includes: a thermoelectric element including a heating surface and a heat absorption surface disposed to oppose the heating surface; a cold sink whose one side contacts with the heat absorption surface of the thermoelectric element to exchange heat; a heat conduction unit evaporation part in which one side is in contact with the heating surface of the thermoelectric element and the other side is connected to a refrigerant pipe of the evaporator to transmit heat emitted from the heating surface of the thermoelectric element to the refrigerant; a first fan heat-exchanging air of the ultra-low temperature compartment with the other side of the cold sink; and a second fan heat-exchanging air of the heat exchange chamber with the other side of the heat conduction unit evaporation part, wherein an amount of heat-exchange between a refrigerant of the heat conduction unit evaporation part and a central portion of the heating surface having a relatively high temperature is greater than an amount of heat-exchange between the refrigerant and a peripheral portion of the heating surface surrounding the central portion.

The heat conduction unit evaporation part may include: a heat exchange plate contacting with the heating surface to exchange heat with the heating surface; and a refrigerant flow channel provided within the heat exchange plate and allowing the refrigerant to flow therein to exchange heat with the heat exchange plate.

The heat exchange plate may have a refrigerant intake port intaking the refrigerant to the refrigerant flow channel and a refrigerant discharge port discharging the refrigerant from the refrigerant flow channel to the outside, and a distance from the refrigerant intake port to a highest temperature point of the heating surface on the refrigerant flow channel may be shorter than a distance from the refrigerant intake port to a lowest temperature point of the heating surface on the refrigerant flow channel.

An average temperature of the refrigerant may be higher in a second region of the heat exchange plate in contact with the peripheral portion of the heating surface than in a first region of the heat exchange plate in contact with the central portion of the heating surface.

Density of the refrigerant flow channel may be lower in the first region of the heat exchange plate in contact with the central portion of the heating surface than in the second region of the heat exchange plate in contact with the peripheral portion of the heating surface.

The refrigerant flow channel may have any one of a coil shape, a concentric circular shape, a radial shape, and a polygonal shape.

The refrigerant flow channel may have a radius of curvature gradually increased from the first region of the heat exchange plate in contact with the central portion of the heating surface toward the second region of the heat exchange plate in contact with the peripheral portion of the heating surface.

The refrigerant flow channel may be provided in one or more rows in a thickness direction of the heat exchange plate.

The refrigerant intake port and the refrigerant discharge port may be provided on a rear surface of the heat exchange plate opposing a contact surface of the heating surface.

The refrigerant intake port may overlap the first region of the heat exchange plate in contact with the central portion of the heating surface in a thickness direction, and the refrigerant discharge port may overlap the second region of the heat exchange plate in contact with the peripheral portion of the heating surface in the thickness direction.

The heat exchange plate may include: a first heat exchange plate having a first refrigerant flow channel recess formed as a concave and long recess on an inner surface thereof; and a second refrigerant flow channel recess disposed to face the first refrigerant flow channel recess on an inner surface thereof and forming one refrigerant flow channel together with the first refrigerant flow channel recess.

The refrigerant intake port and the refrigerant discharge port may be provided to overlap the first region of the first heat exchange plate in contact with the central portion of the heating surface in a thickness direction.

The refrigerator may further include: an insulator disposed between the cold sink and the heat conduction unit evaporation part and surrounding an outer surface of the thermoelectric element.

The heat conduction unit evaporation part may be connected to the evaporator in series to simultaneously perform an operation for cooling the chilling compartment or the freezing compartment and an operation for cooling the ultra-low temperature compartment.

The refrigerator according to the present disclosure has the following advantages.

First, since the heat conduction unit evaporation part has the coil-shaped refrigerant flow channel inducing a refrigerant introduced to the central portion thereto to flow from the central portion toward an outer edge portion, an amount of heat exchange of the refrigerant in the central portion of the heating surface of the thermoelectric element having a relatively high temperature is greater than that of the refrigerant in the outer edge portion of the hating surface, enhancing heat dissipation performance and heat exchange efficiency of the heat conduction unit evaporation part.

Second, since a temperature of the ultra-low temperature storage is realized as −40° C. or lower by effectively designing the refrigerant pipe of the heat conduction unit evaporation part, when food to be kept frozen at an ultra-low temperature such as meat, or the like, is kept in the ultra-low temperature storage, drip loss of meat tissues may be reduced to enhance food quality, and since meat and fish may be kept in a differentiated freezing temperature band, the present disclosure may significantly contribute to strengthening of competitive edge of the product. In addition, a size of the heat conduction unit evaporation part may be reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a body including a heat exchange chamber, a chilling compartment, a freezing compartment, and an ultra-low temperature compartment disposed within the freezing compartment and maintained at a lower temperature than a temperature of the freezing compartment;

an ultra-low temperature cooling device that cools air of the ultra-low temperature compartment, wherein the ultra-low temperature cooling device includes:

a thermoelectric element having a heat absorption surface for absorbing heat from air of the ultra-low temperature compartment and a heating surface for discharging the absorbed heat;

a cold sink including one side that contacts the air and another side that contacts the heat absorption surface of the thermoelectric element;

an evaporation device adjacent the heating surface of the thermoelectric element and connected to a refrigerant pipe of an evaporator within the heat exchange chamber to transmit heat from the heating surface of the thermoelectric element to the evaporator, the evaporation device includes:

a heat exchange plate that contacts the heating surface of the thermoelectric element to exchange heat with the heating surface; and a refrigerant flow channel within the heat exchange plate, and the refrigerant flow channel allows refrigerant from the evaporator to flow in the refrigerant flow channel to exchange heat with the heat exchange plate, wherein the heat exchange plate has a refrigerant intake port for intaking the refrigerant to the refrigerant flow channel, a refrigerant discharge port for discharging the refrigerant from the refrigerant flow channel, and the refrigerant flow channel is provided in a plurality of rows, the plurality of rows including a $1^{st}$ row and a $2^{nd}$ row spaced apart from each other in a thickness direction of the heat exchange plate, wherein the distance from the refrigerant intake port to a highest temperature point of the heating surface of the thermoelectric element is shorter than the distance from the refrigerant intake port to a lowest temperature point of the heating surface of the thermoelectric element, the highest temperature point of the heating surface is positioned at a center portion of the heating surface, and the refrigerant intake port and the refrigerant discharge port are formed to protrude from the heat exchange plate in a direction away from the thermoelectric element, wherein the distance from the 1st row to the heating surface of the thermoelectric element is shorter than the distance from the 2nd row to the heating surface of the thermoelectric element, and the refrigerant intake port communicates with the 1st row of the refrigerant flow channel, and the refrigerant discharge port communicates with the 2nd row of the refrigerant flow channel such that heat dissipation performance of the heat exchange plate is enhanced.

2. The refrigerator of claim 1, wherein the 1st row of the refrigerant flow channel and the 2nd row of the refrigerant flow channel communicate with each other at an outer peripheral portion of the heat exchange plate.

3. The refrigerator of claim 2, wherein the refrigerant in the 1st row flows from a central portion of the heat exchange plate to the outer peripheral portion of the heat exchange plate, and the refrigerant in the 2nd row flows from the outer peripheral portion of the heat exchange plate to the central portion of the heat exchange plate.

4. The refrigerator of claim 1, wherein the refrigerant flow channel has any one of a coil shape, a concentric circular shape, a radial shape, and a polygonal shape.

5. The refrigerator of claim 1, wherein the refrigerant intake port and the refrigerant discharge port are placed to overlap a first region of the heat exchange plate in contact with the center portion of the heating surface in the thickness direction.

6. The refrigerator of claim 1, further comprising:

an insulator disposed between the cold sink and the evaporation device and surrounding an outer surface of the thermoelectric element.

7. The refrigerator of claim 1, wherein the evaporation device is connected to the evaporator in series to perform an operation for cooling the chilling compartment or the freezing compartment and an operation for cooling the ultra-low temperature compartment.

8. The refrigerant of claim 1, wherein the ultra-low temperature cooling device comprises a cooling fan that is to heat-exchange air of the ultra-low temperature compartment with the one side of the cold sink, and the cooling fan, the cold sink, the thermoelectric element, and the evaporation device are configured to contact with each other and are configured to be mounted on a front surface of the heat exchange chamber.

9. The refrigerant of claim 8, wherein the cooling fan, the cold sink, the thermoelectric element, and the evaporation device are arranged to form an assembly, a part of the assembly protrudes from the front surface of the heat exchange chamber into the ultra-low temperature compartment, and the ultra-low temperature compartment is configured to cover the part of the assembly.

10. A refrigerator comprising:

a body including a heat exchange chamber, a chilling compartment, a freezing compartment, and an ultra-low temperature compartment disposed within the freezing compartment and maintained at a lower temperature than a temperature of the freezing compartment;

a drawer assembly in the ultra-low temperature compartment;

an ultra-low temperature cooling device that cools air of the ultra-low temperature compartment, wherein the ultra-low temperature cooling device includes:

a thermoelectric element having a heat absorption surface for absorbing heat from the air of the ultra-low temperature compartment and a heating surface for discharging the absorbed heat;

a cold sink including one side that contacts the air and another side that contacts the heat absorption surface of the thermoelectric element;

an evaporation device adjacent the heating surface of the thermoelectric element and connected to a refrigerant pipe of an evaporator within the heat exchange chamber to transmit heat from the heating surface of the thermoelectric element to the evaporator, the evaporation device includes:

a heat exchange plate that contacts the heating surface of the thermoelectric element to exchange heat with the heating surface; and a refrigerant flow channel within the heat exchange plate, and the refrigerant flow channel allows refrigerant from the evaporator to flow in the refrigerant flow channel to exchange heat with the heat exchange plate, wherein the heat exchange plate has a refrigerant intake port for intaking the refrigerant to the refrigerant flow channel, a refrigerant discharge port for discharging the refrigerant from the refrigerant flow channel, and the refrigerant flow channel is provided in a plurality of rows, the plurality of rows including a 1st row and a 2nd row spaced apart from each other in a thickness direction of the heat exchange plate;

wherein a maximum distance from the refrigerant intake port to a central region of the heat exchange plate on the refrigerant flow channel is shorter than a maximum distance from the refrigerant intake port to an outer peripheral region of the heat exchange plate;

wherein the distance from the 1st row to the heating surface of the thermoelectric element is shorter than the distance from the 2nd row to the heating surface of the thermoelectric element, the refrigerant intake port communicates with the 1st row of the refrigerant flow channel, and the refrigerant discharge port communicates with the 2nd row of the refrigerant flow channel such that heat dissipation performance of the heat exchange plate is enhanced, and the refrigerant intake port and the refrigerant discharge port are formed to protrude from the heat exchange plate in a direction away from the thermoelectric element.

11. The refrigerator of claim 10, wherein the 1st row of the refrigerant flow channel and the 2nd row of the refrigerant flow channel communicate with each other at the outer peripheral portion of the heat exchange plate.

12. The refrigerator of claim 10, wherein the refrigerant in the 1st row flows from the central portion of the heat exchange plate to the outer peripheral portion of the heat exchange plate, and the refrigerant in the 2nd row flows from the outer peripheral portion of the heat exchange plate to the central portion of the heat exchange plate.

* * * * *